US007000785B2

(12) United States Patent
Jafari et al.

(10) Patent No.: US 7,000,785 B2
(45) Date of Patent: Feb. 21, 2006

(54) TUBE RACK ACCOMMODATING A RANGE OF TUBE DIAMETERS

(75) Inventors: Nasser Jafari, American Canyon, CA (US); Lawrence J. Blecka, Walnut Creek, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 0 days.

(21) Appl. No.: 10/408,758

(22) Filed: Apr. 3, 2003

(65) Prior Publication Data

US 2004/0195193 A1 Oct. 7, 2004

(51) Int. Cl.
*A47B 73/00* (2006.01)

(52) U.S. Cl. ..... 211/74; 211/60.1; 422/99

(58) Field of Classification Search ..... 211/74, 211/60.1; 422/104, 99, 65, 102, 100; 206/443, 206/446

See application file for complete search history.

(56) References Cited

U.S. PATENT DOCUMENTS 2,741,913 A * 4/1956 Dovas ..... 73/61.65
3,538,962 A * 11/1970 Gilson ..... 141/131
3,643,812 A * 2/1972 Mander et al. ..... 211/74
3,825,410 A * 7/1974 Bagshawe ..... 436/57
3,858,990 A * 1/1975 Busselmeier ..... 403/194
3,905,482 A * 9/1975 Knulst ..... 211/74
3,918,920 A * 11/1975 Barber ..... 422/104
4,124,122 A * 11/1978 Emmitt ..... 211/74
4,271,878 A * 6/1981 Bologa ..... 141/375
4,324,859 A * 4/1982 Saxholm ..... 435/33
4,422,555 A * 12/1983 Jacobs ..... 211/74
4,510,119 A * 4/1985 Hevey ..... 422/71
4,534,465 A * 8/1985 Rothermel et al. ..... 206/443
4,895,650 A 1/1990 Wang
4,944,924 A 7/1990 Mawhirt et al.
5,128,105 A * 7/1992 Berthold et al. ..... 422/104
5,137,693 A * 8/1992 Mawhirt ..... 422/104
5,186,339 A * 2/1993 Heissler ..... 211/74
5,253,774 A 10/1993 Honig et al.
5,651,941 A * 7/1997 Stark et al. ..... 422/104
5,687,849 A * 11/1997 Borenstein et al. ..... 206/446
5,882,596 A * 3/1999 Breeser et al. ..... 422/65
5,959,221 A 9/1999 Boyd et al.
5,972,295 A 10/1999 Hanawa et al.
5,985,215 A 11/1999 Sakazume et al.
5,993,745 A * 11/1999 Laska ..... 422/104
6,053,338 A * 4/2000 Avery et al. ..... 211/65
6,065,617 A * 5/2000 Cohen et al. ..... 211/74
D428,497 S 7/2000 Lapeus et al.
6,117,392 A 9/2000 Hanawa et al.
6,117,683 A 9/2000 Kodama et al.
6,123,205 A * 9/2000 Dumitrescu et al. ..... 211/74
6,156,275 A 12/2000 Dumitrescu et al.
6,337,050 B1 1/2002 Takahashi et al.
6,444,171 B1 9/2002 Sakazume et al.
6,533,133 B1 * 3/2003 Liu ..... 211/74

* cited by examiner

*Primary Examiner*—Blair M. Johnson
(74) *Attorney, Agent, or Firm*—M. Henry Heines; Townsend and Townsend and Crew, LLP

(57) ABSTRACT

A tube rack for holding and transporting sample tubes or other liquids in an automated analyzer is built to accommodate tubes of different sizes in a stable aligned configuration, the rack containing a row of parallel open-top tube chambers, each chamber containing two sets of resilient tabs integrally molded with the chamber walls and at different heights in the chamber.

9 Claims, 2 Drawing Sheets

TUBE RACK ACCOMMODATING A RANGE OF TUBE DIAMETERS

BACKGROUND OF THE INVENTION

1. Field of the Invention

This invention resides in the field of specimen sampling equipment and liquid handling equipment in general for automated analyzers, with particular attention to racks in which sample tubes are held in such an analyzer.

2. Description of the Prior Art

Laboratory analyzers for the automated analysis of a multitude of biological specimens typically include several coordinated liquid transfer systems and one or more movable sample tube racks. These racks hold the sample tubes in position and transport them to each of various positions in the analyzer where different robotic mechanisms are used for liquid addition and withdrawal in the performance of the different functional operations of the analysis. The optimal rack is one that holds the tubes in a stable manner, thereby preventing the tubes from becoming dislodged or their orientation from being changed as the rack is moved within the analyzer, and also one that aligns the tubes properly for the robotics in the analyzer. The optimal rack should not be limited to any particular tube size but should instead accommodate tubes of different sizes while maintaining proper alignment of each tube regardless of size.

Among the specimen racks of the prior art are those that contain a row of individual tube chambers that are circular in cross section. Each chamber has a single set of spring arms extending from the upper rim of the chamber downward and inward toward the chamber axis to hold the tube in place during movement of the rack. Even with four spring arms distributed around the circumference of the chamber, the tube orientation is only secured at one location along the height of the tube, and the range of tube diameters that the chamber can accommodate is limited. The rack also suffers from costly construction since the spring arms have a V-shaped cross section and are angled at each end toward the vertical. Contributing further to the cost are the fact that the spring arms are constructed as components separate from the body of the rack, the spring arms being metallic and the body itself being of plastic construction. In the assembled rack, the metal spring arms are fitted into the body but susceptible to slippage and potential disengagement.

SUMMARY OF THE INVENTION

The above concerns are addressed by the present invention which resides in a tube rack that holds tubes of a range of diameters and yet holds each tube in a uniform alignment so that the axis of the tube is always in the same alignment in the rack regardless of the tube diameter, with all tube axes being parallel. Each chamber is defined by lateral walls arranged about the axis of the chamber. Unlike the metallic spring arms of the prior art specimen racks, the racks of this invention contain resilient tabs that are integrally molded with these lateral walls as a continuous structure, and each chamber contains two sets of tabs at different heights in the chamber, one set preferably at the open end of the chamber and the other preferably at a distance one-third to two-thirds down the length of the chamber from the opening. In further preferred embodiments of the invention, the tabs are planar without angled ends, and extend from the chamber walls toward the center of the opening at an acute angle of at least about 40°. In still further preferred embodiments, the tabs are of sufficient length that when no tubes are present and the tabs are relaxed, the opening defined by the gaps between the inner ends of the tabs is less than half the width of the opening defined by the opposing walls of the chamber. The range of tube diameters that these chambers can then accommodate extends from a minimum size to a maximum size that is considerably larger than the diameter of the minimum size. These and other features, objects and advantages of the invention will be apparent from the description that follows.

DETAILED DESCRIPTION OF THE INVENTION AND PREFERRED EMBODIMENTS

While this invention is susceptible to a variety of configurations, arrangements and embodiments, the following discussion will focus on a specific example of a tube rack used for sample tubes. The structural and functional aspects of the rack in this example will serve to provide an understanding of the invention as a whole.

Figure 1:
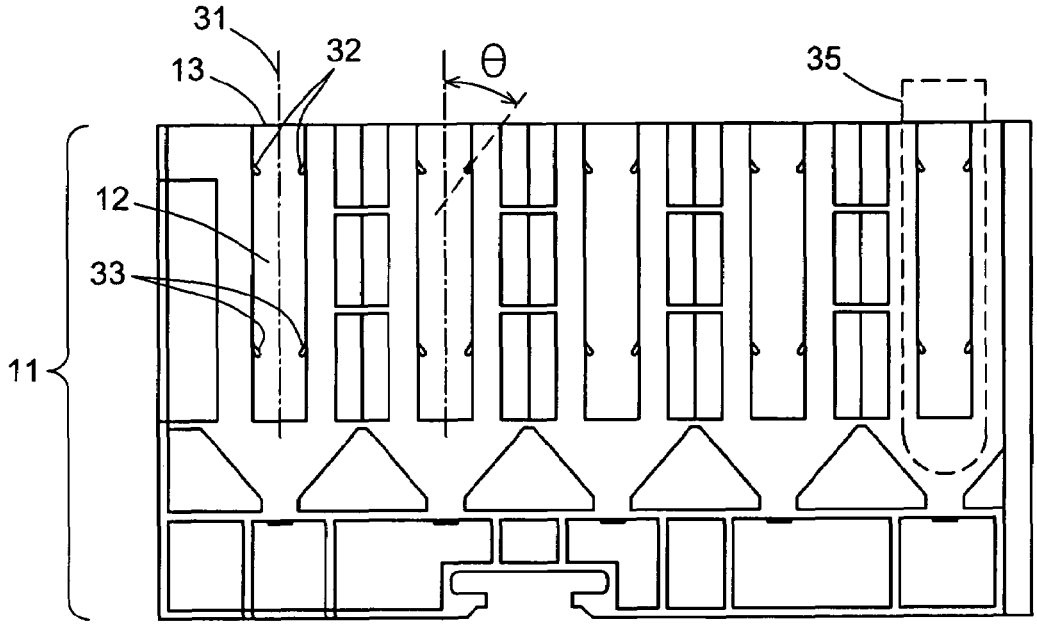
FIG. 1 is a side elevation of a tube rack in accordance with the present invention.
Figure 2:
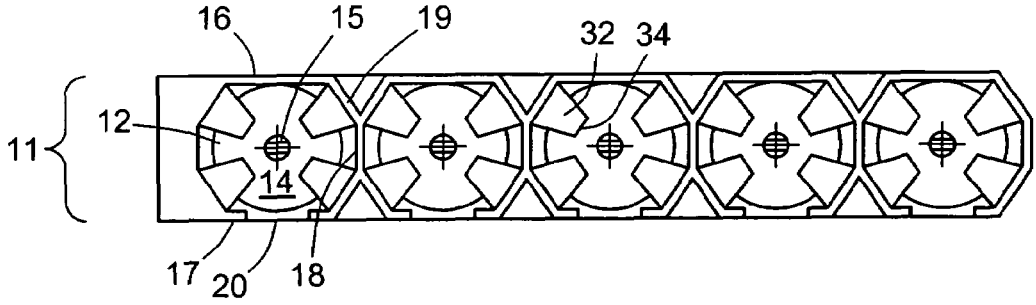
FIG. 2 is a top view of the tube rack of FIG. 1.
Figure 3:
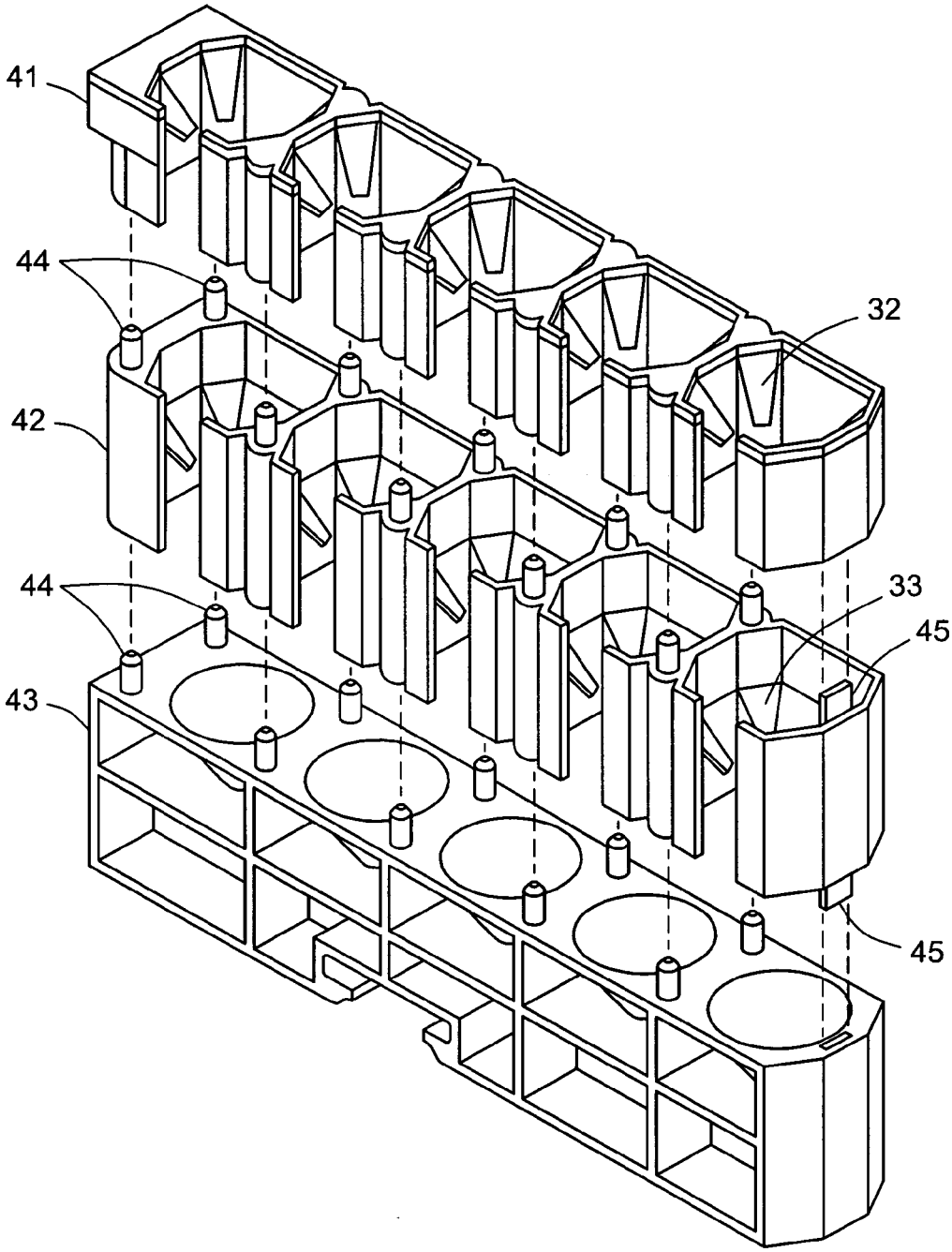
FIG. 3 is a perspective view of the tube rack of FIG. 1 in sections formed by injection molding.

The sample rack is illustrated in three views in FIGS. 1, 2, and 3. Viewing the side elevation of FIG. 1 and the top view of FIG. 2 together, the sample rack 11 is a molded structure that includes five sample tube chambers 12, each chamber open at the top 13 and closed at the bottom with a tapering conical-shaped floor 14 that has an aperture 15 at its center. Each chamber is generally octagonal in cross section, as is most clearly seen in FIG. 2, with eight wall sections including a rear wall 16, a forward wall 17, two side walls formed by lateral partitions 18 that separate the chambers, and four corner walls 19. The forward wall 17 of each chamber has a vertical slot 20 extending the height of the chamber to allow the user to see the contents of a tube retained in the chamber and to reduce the weight of the structure and the amount of material used in its manufacture. The conical floor 14 and its aperture 15 allow any excess or overflow liquid to drain, but the conical shape and aperture are otherwise optional and can be replaced by a flat floor. A ring or disk of rubber or other similar cushioning material (not shown) can be placed in the chamber to rest on the conical floor 14 for purposes of minimizing the chances of breakage of the sample tube due to a sudden or excessive downward force on the tube.

Although each chamber in the example shown in the Figures has a width (side to side) that is greater than its depth (front to back), each chamber is symmetrical about a central axis 31, the axes of all five chambers being parallel. Two sets of resilient tabs extend from the walls of the chamber into the chamber interior toward the axis. The tabs of both sets contact the sample tube and urge it toward the center of the chamber so that the tube axis and the chamber axis are coincident. The two sets of tabs are an upper set 32 and a lower set 33 (as seen in FIG. 1), and each set includes four tabs (as seen in FIG. 2). The tabs are symmetrically arranged relative to the plane passing through all of the chamber axes, while also being symmetrically arranged relative to the plane that includes the chamber axis but is transverse to the plane passing through all chamber axes. Tabs sets with numbers other than four can also be used and the arrangement can be asymmetrical. Also, the upper set may have a number and/or arrangement that differ from the lower set. The number of tabs per set and their arrangement are not critical provided that enough tabs be present in an arrangement that will collectively hold the sample tube in place and limit its position to a coaxial alignment with the chamber axis. Thus, three tabs will suffice in many cases. In the example shown in the Figures, the tabs are on the four corner wall segments, alternating with the walls that do not contain tabs.

Each tab is angled downward, i.e., toward the floor 14 of the chamber, forming an acute angle θ with the axis. This angle is not critical but is preferably more than 40°, and more preferably within the range of about 40° to about 50°. In the example shown, each tab is planar, i.e., the tabs are not angled or bent at the edges or ends and do not have a curvilinear cross section. As mentioned above, the tabs are resilient, such that when a sample tube is inserted into the chamber through the open top 13, the tube presses against the tabs, causing them to bend downward and back toward the chamber wall as they exert a biasing force on the tube urging the tube toward the chamber axis. Upon removal of the tube, the tabs are released and resume their relaxed position as shown in the Figures. Each tab is tapered to terminate at its inner end in a straight edge 34 (FIG. 2), each edge serving as the contact with the sample tube. The length of each tab establishes the range of tube diameters that the rack will hold. In their relaxed position, the tabs establish the minimum tube diameter that will rest stably within the rack, while the maximum tube diameter is slightly less than the distance between the opposing segments of the chamber walls themselves as the tabs are pressed against the walls. Preferably, the maximum tube diameter is about 1.5 times the minimum. It is further preferred that the shortest distance between opposing walls of the chamber be at least about 1.7 cm while the shortest distance between opposing inner edges of the tabs be at most about 0.75 cm. These measurements are not critical and are set forth as examples.

The exterior of the sample rack shown in these Figures is shaped to contain various indentations and ribs whose outlines are visible in FIG. 1. The indentations serve to reduce the weight of the rack and the amount of material needed for its manufacture, while the ribs provide structural support to enhance the rigidity of the rack.

Sample tubes that can be retained by the racks of this invention include tubes of any cross section, although the racks are of particular utility with cylindrical tubes of circular cross section. One such tube 35 is shown in dashed lines in FIG. 1.

Any of various materials of construction that can be formed by injection molding or other types of molding can be used in the manufacture of the racks of this invention. Examples are polypropylenes, polyethylenes, and polyamides. Other examples will be readily apparent to those skilled in the art. As noted above, the tabs of the sample racks of this invention are integrally molded as a continuous structure with the walls of the chambers, i.e., the tabs are not formed as separate pieces and then attached to the walls but rather each tab and the wall section from which the tab extends is formed in a single molding operation. The entire rack can be formed as a single molded piece, but in a presently preferred method, the rack is molded in three sections 41, 42, 43 as shown in FIG. 3, with pegs 44 and tabs 45 mating with appropriate slots 46 and holes (not visible) to fit the three sections together, the upper set of tabs 32 being molded as part of the upper section 41 of the rack and the lower set of tabs 33 as part of the middle section 42.

The foregoing is offered primarily for purposes of illustration. Further alternatives as well as modifications and variations of the configurations, systems, materials, and procedural steps described above, which will be apparent to those skilled in the art upon reading this specification, are included within the scope of this invention.

What is claimed is:

1. A tube rack comprising a row of parallel chambers joined to each other, each chamber open at one end and each chamber comprising:

lateral walls arranged about an axis, and first and second sets of resilient tabs, each tab integrally molded as a continuous structure with one of said walls and each tab extending toward, and at an acute angle to, said axis and away from said open end, each set of tabs comprising at least three of said tabs arranged about said axis in a centering arrangement to receive and hold a cylindrical tube of circular cross section inside said chamber in a stable position coaxial with said chamber, said first set of tabs axially displaced from said second set of tabs, said tube rack comprising separate upper, middle, and lower molded sections and means for fitting said sections together, said first set of tabs being molded as part of said upper section, and said second set of tabs being molded as part of said middle section.

2. A tube rack in accordance with claim 1 in which each set of tabs consists of four of said tabs symmetrically arranged about a plane that includes said axis.

3. A tube rack in accordance with claim 1 in which said tabs of said first set are joined to said walls at said open end of each chamber, and said tabs of said second set are joined to said walls at a distance from said open end ranging from one-third to two-thirds of the length of each chamber.

4. A tube rack in accordance with claim 1 in which each of said tabs is planar and terminates at an inner edge such that only said inner edge will contact said circular cylindrical tube when such a tube is received within said chamber.

5. A tube rack in accordance with claim 4 in which said tabs in any one set when relaxed define an opening having a width that is less than one-half of the shortest distance between opposing lateral walls in any single chamber.

6. A tube rack in accordance with claim 4 in which the shortest distance between opposing lateral walls in any single chamber is at least about 1.7 cm and the shortest distance between opposing inner edges of tabs in any single chamber is at most about 0.75 cm.

7. A tube rack in accordance with claim 1 in which each of said tabs is planar and said acute angle is from about 40° to about 50°.

8. A tube rack in accordance with claim 1 in which said tabs and said walls are constructed of a member selected from the group consisting of polypropylene, polyethylene, and polyamide.

9. A tube rack in accordance with claim 1 in which said lateral walls are comprised of planar wall sections providing each said chamber with an octagonal cross section, each set of tabs consisting of four tabs extending from wall sections that alternate with wall sections containing no tabs.

* * * * *